US005507889A

United States Patent [19]

Mullay et al.

[11] Patent Number: 5,507,889

[45] Date of Patent: Apr. 16, 1996

[54] PRECOMPRESSION RESISTANT EMULSION EXPLOSIVE

[75] Inventors: John J. Mullay, Hazleton; Jane M. Farkas, Palmerton; Cathy J. McGinley, Coaldale, all of Pa.

[73] Assignee: ICI Explosives USA Inc., Tamaqua, Pa.

[21] Appl. No.: 409,745

[22] Filed: Mar. 24, 1995

[51] Int. Cl.[6] ..... C06B 45/00

[52] U.S. Cl. ..... 149/2; 149/60; 149/83; 149/85; 149/110

[58] Field of Search ..... 149/2, 46, 110, 149/60, 76, 83, 85

[56] References Cited

U.S. PATENT DOCUMENTS 5,017,251 5/1991 Lawrence et al. ..... 149/2

*Primary Examiner*—Donald P. Walsh
*Assistant Examiner*—Anthony R. Chi
*Attorney, Agent, or Firm*—Charles Q. Buckwalter

[57] ABSTRACT

An emulsion explosive composition having improved resistance to precompression desensitization comprising an emulsion explosive matrix and a high level of a low strength microspheres. Preferably, the microspheres having a crush strength of between 100 and 400 psi, and are present in at least 4% by weight of the formulation. Accordingly, the present invention allows the use of a more standard (and usually less expensive) microspheres in the production of a precompression desensitization-resistant emulsion explosive. Further, the emulsion explosives of the present invention would permit emulsion explosives, in general, to be utilized in a wider range of applications.

7 Claims, No Drawings

PRECOMPRESSION RESISTANT EMULSION EXPLOSIVE

FIELD OF THE INVENTION

This invention relates to the field of emulsion explosives, and in particular to an emulsion explosive which is resistant to precompression desensitization.

DESCRIPTION OF THE RELATED ART

The use of water in oil emulsion explosives has become of increasing importance in the mining industry. One of the remaining serious problems which hampers the use of these explosives in a number of applications is their lack of resistance to precompression. This term refers to the phenomena whereby an emulsion explosive is rendered insensitive to initiation by the action of a shock or gas pressure pulse from a previously detonated adjoining borehole. The existence of this phenomena significantly restricts the usefulness of these types of explosives.

Emulsion explosives are well known within the explosives industry. These explosives can generally be described as being the emulsion of a melt or aqueous solution of an oxidizing salt, such as ammonium nitrate, which forms a discontinuous phase, in a continuous organic fuel phase. The emulsion is typically stabilized by the addition of an emulsifier to the continuous phase. In order to provide sensitivity to this type of explosive, gas voids are generally added or formed within the emulsion, and are normally introduced by utilizing glass or plastic microspheres (also termed "microballoons") or by gassing. Unfortunately, it is the premature collapse of these voids, under pressure from the shock wave generated by the detonation of adjoining boreholes, that is the major cause of precompression desensitization.

One of the most commercially important solutions to this problem has been the use of the so-called high strength microspheres. These microspheres are able to withstand the pressures typically encountered during precompression in the borehole environment without breaking. However, there are disadvantages to using these high strength microspheres. First, there is an economic disadvantage since it is necessary to use a relatively large amount of these microspheres in order to obtain a sufficiently low density which will provide adequate sensitization. Further, it is extremely difficult to formulate an explosive which has both sufficient explosive strength and which is also sufficiently sensitive for normal applications, using these high strength microspheres.

One method to overcome these resultant problems has been to use additional sensitizing agents. By adoption of this strategy, the sensitivity of the emulsion explosive is less dependent on the use of void materials, and thus these emulsions are less prone to desensitization by precompression. However, these additional sensitizing agents are typically added to the emulsion after it had been formed. Accordingly, it is necessary to handle generally solid sensitizers, and to mix them into a hot emulsion. The safety concerns with this approach are obvious.

A second method to overcome these problems has been to include "cushioning" agents within the emulsion formulation. Unfortunately, these cushioning agents are primarily carbonaceous materials which add additional fuel to the emulsion. This can cause considerable difficulties for the formulator attempting to produce a product having specific detonation characteristics, such as providing a Fume Class 1 high energy material. Thus, the addition of these materials can cause serious restrictions on the range of applications for the emulsion explosives.

In addition to precompression resistance, there is a need that exists in the mining industry for a low density explosive. Previous art has attempted to solve this problem by adding a combination of high strength microspheres as well as gassing. This solution, unfortunately, leads to additional problems. In addition to the problems already mentioned with regard to high strength microspheres, it is difficult to obtain a high quality explosive utilizing gassing technology. If both technologies are used in combination, it becomes even more difficult to achieve a high quality explosive. Accordingly, it would be desirable to provide an emulsion explosive with improved resistance to precompression desensitization without the necessity of resorting to high strength microspheres, or resorting to a combination of high strength microspheres and gassing technology.

SUMMARY OF THE INVENTION

Accordingly, the present invention provides an emulsion explosive comprising an emulsion explosive matrix in combination with a high level of low strength microspheres.

This is in direct contrast to the previous understanding of the use of microspheres in explosive compositions. Prior to the present invention, it was conventional wisdom that the microspheres which should be used to provide resistance to precompression desensitization should be high strength microspheres. This approach led to the formulation difficulties described hereinabove.

The preferred microspheres of the present invention are made of glass or resinous materials, such as phenol-formaldehyde, urea-formaldehyde and copolymers of vinylidene chloride and acrylonitrile. Generally, these materials are graded by their resistance to crushing when subjected to an external force. Low strength microspheres typically have a crushing strength of about 250 psi, intermediate strength microspheres have a crushing strength of about 500 psi and high strength microspheres have a crushing strength of about 2000 psi. Accordingly, the preferred microspheres of interest in the practise of the present invention are those microspheres having a crush strength of less than 400 psi, more preferably having a crush strength of between 100 and 400 psi, and most preferably, having a crush strength of between 200 and 300 psi.

Crush strength is measured, in accordance with the method described by 3M in their Scotchlite (trade mark) glass bubbles User's guide, by the following procedure. Isostatic strength values are obtained by applying isostatic pressures in accordance with ASTM D3102 (1982 edition) to cause 10% volume loss in glycerol.

In typical prior art applications, low strength microspheres are normally utilized at levels below 4% by weight of the total formulation (ie emulsion explosive matrix and microspheres). Most typically, low strength microspheres are generally utilized at levels of about 2.5% by weight. In the practise of the present invention, the microspheres are preferably used at levels greater than 4%, more preferably at levels between 4 and 15%, and most preferably at levels between 6 and 8% by weight of the total formulation.

Used at these levels of microspheres, the resultant emulsion explosive preferably has a density of less than about 0.95 g/cc, and more preferably, has a density of less than 0.90 g/cc.

Accordingly, in one preferred embodiment, the present invention provides an emulsion explosive which has improved resistance to precompression desensitization (when compared to typical emulsion explosives) comprising 85 to 96% by weight of an emulsion explosive matrix and between 4 and 15% by weight of microspheres having a crush strength of between 100 and 400 psi, and having a density of less than 0.95 g/cc.

As discussed hereinabove, precompression desensitization is a term well known in the explosives industry, and the degree of resistance to this phenomena is readily determined by those ski 1 led in the art. Preferably, however, the degree of improvement in resistance to precompression desensitization, is evaluated according to the test procedure set out in the examples hereinbelow.

When tested for precompression resistance, standard emulsion explosives having typical levels of low strength microspheres have a precompression resistance value of about 20 cm or higher. The preferred emulsion explosives prepared in accordance with the present invention have a precompression resistance value of less than 18 cm, more preferably less than 15 cm, and most preferably less than 10 cm.

The term "emulsion explosive matrix" is used to describe the emulsion explosive composition prior to the addition of the microspheres, and generally comprises the discontinuous oxidizer salt phase, and the continuous water-immiscible organic fuel phase, with emulsifier.

The emulsion explosive matrix utilized in the practise of the present invention may be based on any of the typical emulsion explosives known in the industry.

The oxidizer salt for use in the discontinuous phase of the emulsion explosives are preferably selected from the group consisting of alkali and alkaline earth metal nitrates, chlorates and perchlorates, ammonium nitrate, ammonium chlorates, ammonium perchlorate and mixtures thereof. It is particularly preferred that the oxidizer salt is ammonium nitrate, or a mixture of ammonium and sodium nitrate.

A preferred oxidizer salt mixture can comprise, for example, a solution of 77% ammonium nitrate, 11% sodium nitrate and 12% water.

The oxidizer salt is typically a concentrated aqueous solution of the salt or mixture of salts. However, the oxidizer salt may also be a liquefied, melted solution of the oxidizer salt where a lower water content is desired. It may be desirable that the discontinuous phase of the emulsion explosive be a eutectic composition. By eutectic composition it is meant that the melting point of the composition is either at the eutectic or in the region of the eutectic or the components of the composition.

The oxidizer salt for use in the discontinuous phase of the emulsion may further comprise a melting point depressant. Suitable melting point depressants for use with ammonium nitrate in the discontinuous phase include inorganic salts such as lithium nitrate, silver nitrate, lead nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetate, and ammonium acetate; glycine; chloracetic acid; glycolic acid; succinic acid; tartaric acid; adipic acid; lower aliphatic amides such as formamide, acetamide and urea; urea nitrate; nitrogenous substances such as nitroguanidine, guanidine nitrate, methylamine, methylamine nitrate, and ethylene diamine dinitrate; and mixtures thereof.

Typically, the discontinuous phase of the emulsion comprises 60 to 97% by weight of the emulsion explosive matrix, and preferably greater than about 70% by weight of the emulsion explosive matrix.

The continuous water-immiscible organic fuel phase of the emulsion explosive comprises an organic fuel. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes, (e.g. microcrystalline wax, paraffin wax and slack wax), paraffin oils, benzene, toluene, xylenes, asphaltic materials, polymeric oils such as the low molecular weight polymers of olefins, animal oils, fish oils, vegetable oils, and other mineral, hydrocarbon or fatty oils, and mixtures thereof. Preferred organic fuels are liquid hydrocarbons, generally referred to as petroleum distillates, such as gasoline, kerosene, fuel oils and paraffin oils.

Typically, the continuous water-immiscible organic fuel phase of the emulsion explosive matrix comprises 3 to 30% by weight of the emulsion explosive, and preferably 5 to 15% by weight of the emulsion explosive matrix.

The emulsion explosive comprises an emulsifier component to aid in the formation to the emulsion, and to improve the stability of the emulsion. The emulsifier component may be chosen from the wide range of emulsifying agents known in the art to be suitable for the preparation of emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amine, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), condensation products of compounds comprising at least one primary amine and poly[alk(en)yl]succinic acid or anhydride, and mixtures thereof.

Among the preferred emulsifying agents are the 2-alkyl- and 2-alkenyl-4,4'-bis (hydroxymethyl) oxazolines, the fatty acid esters of sorbitol, lecithin, copolymers of poly(oxyalkylene)glycols and poly( 12-hydroxystearic acid), condensation products of compounds comprising at least one primary amine and poly[alk(en)yl] succinic acid or anhydride, and mixtures thereof.

More preferably the emulsifier component comprises a condensation product of a compound comprising at least one primary amine and a poly[alk(en)yl]succinic acid or anhydride. A preferred emulsifier is a polyisobutylene succinic anhydride (PIBSA) based surfactant. These emulsifier may be generally described as condensation products of a poly [alk(en)yl]succinic anhydride and an amine such as ethylene diamine, diethylene triamine and ethanolamine.

Typically, the emulsifier component of the emulsion explosive comprises up to 5% by weight of the emulsion explosive matrix. Higher proportions of the emulsifier component may be used and may serve as a supplemental fuel for the composition, but in general it is not necessary to add more than 5% by weight of emulsifier component to achieve the desired effect. Stable emulsions can be formed using relatively low levels of emulsifier component and for reasons of economy, it is preferable to keep to the minimum amounts of emulsifier necessary to achieve the desired effect. The preferred level of emulsifier component used is in the range of from 0.4 to 3.0% by weight of the emulsion explosive matrix.

If desired other, optional fuel materials, hereinafter referred to as secondary fuels, may be incorporated into the emulsion explosives. Examples of such secondary fuels include finely divided solids. Examples of solid secondary fuels include finely divided materials such as: sulfur; aluminum; carbonaceous materials such as gilsonite, comminuted coke or charcoal, carbon black, resin acids such as abietic acid, sugars such as glucose or dextrose and other vegetable products such as starch, nut meal, grain meal and wood pulp; and mixtures thereof.

Typically, the optional secondary fuel component of the emulsion explosive comprises from 0 to 30% by weight of the emulsion explosive matrix.

The emulsion explosives of the present invention are preferably oxygen balanced. Having an oxygen balance typically provides a more efficient explosive which, when detonated, leaves fewer un-reacted components. Additional components may be added to the explosive to control the oxygen balance.

While the present invention provides an emulsion explosive having suitable sensitivity, density, and resistance to precompression desensitization, additional gassing may be desirable. Accordingly, the explosive may additionally comprise a further discontinuous gaseous component which gaseous component can be utilized to vary the density and/or the sensitivity of the explosive composition.

Further, other suitable porous materials including expanded minerals such as perlite, and expanded polymers such as polystyrene, may be added to the emulsions of the present invention.

The traditional methods of incorporating a gaseous component and enhancing the sensitivity of explosive compositions comprising gaseous components are well known to those skilled in the art. The gaseous components may, for example, be incorporated into the explosive composition as fine gas bubbles dispersed through the composition.

A discontinuous phase of fine gas bubbles may also be incorporated into the explosive composition by mechanical agitation, injection or bubbling the gas through the composition, or by chemical generation of the gas in situ.

Suitable chemicals for the in situ chemical generation of gas bubbles include peroxides, such as hydrogen peroxide, nitrites, such as sodium nitrite, nitrosoamines, such as N,N'-dinitrosopentamethylene-tetramine, alkali metal borohydrides, such as sodium borohydride, and carbonates, such as sodium carbonate. Preferred chemical for the in situ generation of gas bubbles are nitrous acid and its salts which decompose under conditions of acid pH to produce gas bubbles. Preferred nitrous acid salts include alkali metal nitrites, such as sodium nitrite. Catalytic agents such as thiocyanate or thiourea may be used to accelerate the decomposition of a nitrite gassing agent.

The emulsion explosives prepared in accordance with the present invention may be utilized in any of those applications where more traditional emulsion explosives are currently utilized.

When utilized in accordance with the present invention, the emulsion explosive preferably has formulations in accordance with the guidelines set out hereinbelow:

| Ingredient | Wt % |
|---|---|
| Oxidizer Salts (Nitrates, Perchlorates) | >about 70% |
| Water | 4–20 |
| Sensitizers | 0–40 |
| Additional Fuels, Densifiers | 0–50 |
| Low strength microballoons | 4–15 |
| Water Immiscible, Emulsifiable, Fuel Component | 0–10 |
| Emulsifier | 0.5–6 |

Emulsion explosives prepared in accordance with the present invention can allow the formulation of precompression desensitization resistant emulsion explosive products which do not require, or which minimize the use of, special high strength microspheres, cushioning agents or sensitizing agents. It thus permits the explosives formulator to prepare emulsion explosives using more traditional, and less expensive components. In addition, it allows the explosive formulator more flexibility in providing precompression resistant emulsion explosives.

The invention will now be described by way of example only, by reference to the following examples.

EXAMPLES

A number of different emulsion explosives were prepared and the properties of each explosive were measured with respect of density and precompression resistance. The precompression resistance of each formulation was measured using the following test procedure. In this test a donor charge containing 2 g of PETN (pentaerythritol tetranitrate) and a receiver cartridge (32 mm×200 mm paper cartridge containing the test explosive material) were placed under water at a known distance. The receiver cartridge was primed with a #8 EB cap which was delayed for 75 milliseconds after the donor charge cap. Detonation results were determined either by inspection or by detonation velocity measurements or both. The smaller the distance between donor and receiver cartridge in which the receiver will remain detonable, the more precompression resistant the sample material.

The formulations of the emulsions utilized to prepare the packaged products tested are presented in Table 1, together with the density of the resultant emulsion and the result of a precompression test conducted on the single emulsion formulation.

TABLE 1

| | Emulsion formulations | | | | |
|---|---|---|---|---|---|
| | A | B | C | D | E |
| Ammonium Nitrate | 72.8 | 71.0 | 69.1 | 71.8 | 69.8 |
| Sodium Nitrate | 10.0 | 9.7 | 9.4 | 9.8 | 9.6 |
| Water | 10.0 | 9.7 | 9.5 | 9.9 | 9.6 |
| Water-Immiscible Fuel | 3.6 | 3.5 | 3.4 | 2.4 | 2.4 |
| Emulsifier | 1.1 | 1.1 | 1.1 | 3.6 | 3.6 |
| Low strength Microspheres* | 2.5 | 5.0 | 7.5 | 2.5 | 5.0 |
| Density (g/cc) | 1.06 | 0.89 | 0.74 | 1.01 | 0.88 |
| Precompression Resistance (cm) | 20 | 17 | 11 | 18 | 8 |

* - K1GMB microballoons having a crush strength of about 250 psi

From Table 1, it can be seen that formulations B, C and E, which contain high levels of low strength microspheres, and are more resistant to precompression desensitization than formulations A and D which contain more typical levels of microspheres. Accordingly, it is demonstrated that high levels of low strength microspheres can be utilized to provide improved precompression resistance.

Further, when compared to the test results obtained using an non-emulsion, high performance NG (nitroglycerine) based explosive, the emulsion prepared in Example "E" compared favourably with the precompression value of 8 cm obtained for the NG explosive.

Having described specific embodiments of the present invention, it will be understood that modifications thereof may be suggested to those skilled in the art, and it is intended to cover all such modifications as fall within the scope of the appended claims.

The embodiments of the invention in which an exclusive property or privilege is claimed are defined as follows:

1. An emulsion explosive consisting of a density of less than 0.95 g/cc comprising an emulsion explosive matrix and at least 4% by weight of low strength microspheres wherein said microspheres consist essentially of microspheres with a crushing strength of less than 400 psi.

2. The emulsion explosive as claimed in claim 1 wherein said low strength microspheres have a crushing strength of between 100 and 400 psi.

3. The emulsion explosive as claimed in claim 1 comprising 85 to 96% by weight of emulsion explosive matrix, and 4 to 15% by weight of low strength microspheres.

4. The emulsion explosive as claimed in claim 3 comprising 92 to 94% by weight of emulsion explosive matrix, and between 6 and 8%, by weight of low strength microspheres.

5. The emulsion explosive as claimed in claim 4 having a density of less than 0.90 g/cc.

6. The emulsion explosive as claimed in claim 1 having a precompression resistance value of less than 15 cm.

7. The emulsion explosive as claimed in claim 1 having a precompression resistance value of less than 10 cm.

* * * * *